US006869278B2

(12) United States Patent
Streit

(10) Patent No.: US 6,869,278 B2
(45) Date of Patent: Mar. 22, 2005

(54) OUTDOOR GAS FIREPLACE

(75) Inventor: Robin Michael Streit, Prior Lake, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/444,316

(22) Filed: May 22, 2003

(65) Prior Publication Data

US 2004/0231658 A1 Nov. 25, 2004

(51) Int. Cl.[7] ..... F23H 2/32; F23B 1/18

(52) U.S. Cl. ..... 431/125; 126/500; 126/512; 126/547

(58) Field of Search ..... 431/125; 126/512, 126/519, 544, 547, 545, 92 R, 92 B, 91 R, 86, 92 C, 523, 524, 546, 92 AC, 528, 531, 552

(56) References Cited

U.S. PATENT DOCUMENTS

| | | | | | |
|---|---|---|---|---|---|
| 962,752 | A | * | 6/1910 | Dudgeon | 126/512 |
| 1,621,135 | A | * | 3/1927 | Sala | 126/531 |
| 1,653,466 | A | * | 12/1927 | Nickels | 126/531 |
| 1,703,459 | A | * | 2/1929 | Sala | 126/512 |
| 1,884,746 | A | * | 10/1932 | Kline et al. | 126/92 AC |
| 2,517,071 | A | * | 8/1950 | Wyatt | 126/92 AC |
| 2,682,305 | A | * | 6/1954 | Kozlowski | 160/351 |
| 3,336,914 | A | * | 8/1967 | Ruhl | 126/90 R |
| 4,048,979 | A | * | 9/1977 | LaVasseur | 126/548 |
| 4,360,053 | A | * | 11/1982 | Buckner | 160/352 |
| 4,607,611 | A | * | 8/1986 | Rice et al. | 126/531 |
| 4,838,781 | A | * | 6/1989 | Fischer | 431/125 |
| 5,054,468 | A | * | 10/1991 | Moon et al. | 126/512 |
| 5,127,392 | A | * | 7/1992 | Mizuno et al. | 126/92 R |
| 5,139,011 | A | * | 8/1992 | Moon | 126/512 |
| 5,678,534 | A | * | 10/1997 | Fleming | 126/512 |
| 5,738,084 | A | * | 4/1998 | Hussong | 126/512 |
| 5,839,428 | A | * | 11/1998 | Schroeter et al. | 126/512 |
| 5,906,197 | A | * | 5/1999 | French et al. | 126/512 |
| 5,934,268 | A | * | 8/1999 | Onocki | 126/512 |
| 5,941,237 | A | | 8/1999 | Shimek et al. | |
| 5,960,789 | A | * | 10/1999 | Fleming | 126/512 |
| 5,996,575 | A | | 12/1999 | Shimek et al. | |
| 6,145,502 | A | | 11/2000 | Lyons et al. | |
| 6,170,481 | B1 | | 1/2001 | Lyons et al. | |
| 6,216,687 | B1 | * | 4/2001 | Campbell et al. | 126/512 |
| 6,237,588 | B1 | | 5/2001 | Hawkinson | |
| 6,425,390 | B2 | * | 7/2002 | Campbell et al. | 126/512 |

(List continued on next page.)

FOREIGN PATENT DOCUMENTS

| | | | | |
|---|---|---|---|---|
| EP | 0047996 | * | 3/1982 | F24B/1/18 |
| JP | 02-68425 | * | 3/1990 | F24C/1/10 |

OTHER PUBLICATIONS

Heat–N–Glo Lifestyle Products Installation and Operating Instructions for the Montana–36 and Montana–42 Outdoor Woodburning Fireplace; Jan. 2004; 28 pages; 4039–150 Rev B.

*Primary Examiner*—Carl D. Price
(74) *Attorney, Agent, or Firm*—Merchant & Gould P.C.

(57) ABSTRACT

A fireplace for viewing outside of a house or other structure that includes a combustion chamber defined by a combustion chamber enclosure with a front opening and a front panel at least partially enclosing the front opening. The front panel is partially surrounded by an air intake/gas exhaust system. The air intake/gas exhaust system is defined by bottom intake, a top exhaust and at least one of side intake/exhaust opening. A gas burner is situated on the floor of the combustion chamber enclosure. Fresh air enters through a bottom intake opening in the bottom intake and the lower portion of the intake/exhaust opening. After the combustion exhaust gases are expelled through a top exhaust opening in the top exhaust and the upper portion of the intake/exhaust openings.

26 Claims, 4 Drawing Sheets

U.S. PATENT DOCUMENTS 6,578,570 B2 * 6/2003 Fogliani et al. ..... 126/512
D477,062 S 7/2003 Richard
6,601,579 B2 8/2003 Fier et al.
2001/0032641 A1 * 10/2001 Campbell et al.
2003/0029442 A1 2/2003 Davis et al.
2003/0029443 A1 2/2003 Davis et al.
2003/0041855 A1 3/2003 Grady et al.
2003/0049575 A1 3/2003 Lyons et al.

* cited by examiner

OUTDOOR GAS FIREPLACE

FIELD OF THE INVENTION

The present invention relates to fireplaces. More particularly, the invention relates to a gas fireplace adapted for viewing outside of a house or other structure.

BACKGROUND OF THE INVENTION

Fireplaces have been in use for years and are an efficient method for providing warmth and providing the appeal of a fire. Fireplaces have become commonplace in today's building trades for both residential and commercial applications. Most new home construction designs include at least one, and often several fireplaces. Further, a significant number of remodeling projects are focused on fireplaces. Gas, electric, and wood-burning fireplaces are commonly installed to provide benefits such as heat and the aesthetic appeal of a fire.

Outdoor fireplaces are commonly wood burning and are often limited to small devices placed on decks or patios for holding firewood. These fireplaces are often impractical to use when the wind is blowing or the weather is intemperate. Wind can blow ash, soot and sparks from the fireplace and rain or snow can extinguish the fire. After using the fireplace and the fire is extinguished the operator is confronted with removing and disposing of the debris and ash from the fireplace. Consistent with any wood burning device the operator must obtain and store firewood. Starting a fire in a wood burning fireplace is often problematic for the operator. While these fireplaces may be suitable for the particular purpose to which they address, they are not as suitable for providing an efficient, appealing and hassle-free method of enjoying a fire outdoors.

Gas fireplaces in the home alleviate a number of the problems associated with wood burning fireplaces. Gas fireplaces provide easy ignition and eliminate the ash, soot and other debris associated with wood burning fireplaces. However, gas fireplaces typically include a lower air plenum beneath the gas burner to support airflow to the gas burner for combustion and also include an exhaust vent to allow exhaust gases to exit the combustion chamber. These requirements for typical gas fireplaces limit the design options and locations that a fireplace can be installed. Therefore, what is needed is a means to experience the benefits of indoor gas fireplaces outside a home or other structure while providing the aesthetic appeal of a wood burning fireplace and allowing the burner assembly to be placed low to the ground while not requiring a exhaust vent out the back or top of the fireplace thereby maximizing the locations that the fireplace can be placed.

In these respects, the outdoor gas fireplace according to the present invention departs from the conventional concepts and designs of the prior art, and in so doing provides an apparatus primarily developed for the purpose of providing a gas fireplace for the outdoors with the aesthetic appeal of a wood burning fireplace.

SUMMARY OF THE INVENTION

Generally, the present invention relates to fireplaces. More particularly, the invention relates to a fireplace for use outside of a house or other structure. The general purpose of the present invention, which will be described subsequently in greater detail, is to provide a new outdoor gas fireplace that has many advantageous features.

To attain this, the present invention generally comprises a combustion chamber defined by a combustion chamber enclosure, a front panel, and an air intake/gas exhaust system. The air intake/gas exhaust system is defined by a bottom intake defining at least one bottom intake opening, a top exhaust defining at least one top exhaust opening, and a pair of side grille bars at least partially covering a pair of side intake/exhaust openings. The design of the present invention allows the burner assembly to be placed low to the ground surface without the need for a plenum underneath the burner assembly. Additionally, the unique air flow design removes the need for a venting apparatus out the top or back of the fireplace as in most indoor fireplace assemblies.

Air is drawn in through the bottom intake openings and the lower portions of the intake/exhaust openings that are at least partially covered by side grille bars, and exhaust gases are expelled out the top exhaust openings and the upper portions of the intake/exhaust openings that are at least partially covered by the side grille bars. This circular flow provides for a clean burning, attractive outdoor fireplace.

In one aspect, a fireplace for viewing outside of a structure may include a combustion chamber defining a combustion chamber enclosure with a front opening; a panel at least partially covering the front opening of the combustion chamber enclosure; a gas burner system located within the combustion chamber; a lower air intake design coupled to the combustion chamber to supply fresh air from the outside to the combustion chamber; and an upper exhaust design for expelling exhaust air from the combustion chamber to the outside of the combustion chamber.

In another aspect, the invention relates to a fireplace for viewing outside of a structure that may include a combustion chamber defining a combustion chamber enclosure with a front opening; a panel at least partially covering the front opening of the combustion chamber enclosure; a gas burner system located within the combustion chamber; a lower air intake design coupled to the combustion chamber to supply fresh air from the outside to the combustion chamber; an upper exhaust design for expelling exhaust air from the combustion chamber to the outside of the combustion chamber, and a housing at least partially surrounding the combustion chamber, wherein the housing is sealed to reduce condensation entering the fireplace from the outside of the structure.

In another aspect, the invention relates to a method for operating a fireplace for viewing outside of a structure, the method including the steps of: providing a combustion chamber defining a combustion chamber enclosure with a front opening and a panel at least partially covering the front opening of the combustion chamber enclosure; locating a gas burner system within the combustion chamber; providing a lower air intake design coupled to the combustion chamber to supply fresh air from the outside to the combustion chamber; and providing an upper exhaust design for expelling exhaust air from the combustion chamber to the outside of the combustion chamber.

In another aspect, the invention relates to a fireplace for viewing outside of a structure, the fireplace including a combustion chamber defining a combustion chamber enclosure with a front opening, a panel at least partially covering said opening; wherein the combustion chamber enclosure is viewable through said panel; a burner disposed within the combustion chamber; a means for supplying fresh air from the outside of the structure; and a means for exhausting exhaust air from the combustion chamber to the outside of the structure.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

The above summary of the present invention is not intended to describe each disclosed embodiment or every implementation of the present invention. Before explaining at least one embodiment of the invention in detail, it is to be understood that the invention is not limited in its application to the details of construction and to the arrangements of the components set forth in the following description or illustrated in the drawings. Figures in the detailed description that follow more particularly exemplify embodiments of the invention. The invention is capable of other embodiments and of being practiced and carried out in various ways. Also it is to be understood that the phraseology and terminology employed herein are for the purpose of the description and should not be regarded as limiting.

To the accomplishment of the above, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The invention may be more completely understood in consideration of the following detailed description of various embodiments of the invention in connection with the accompanying drawings, in which.

Figure 1:
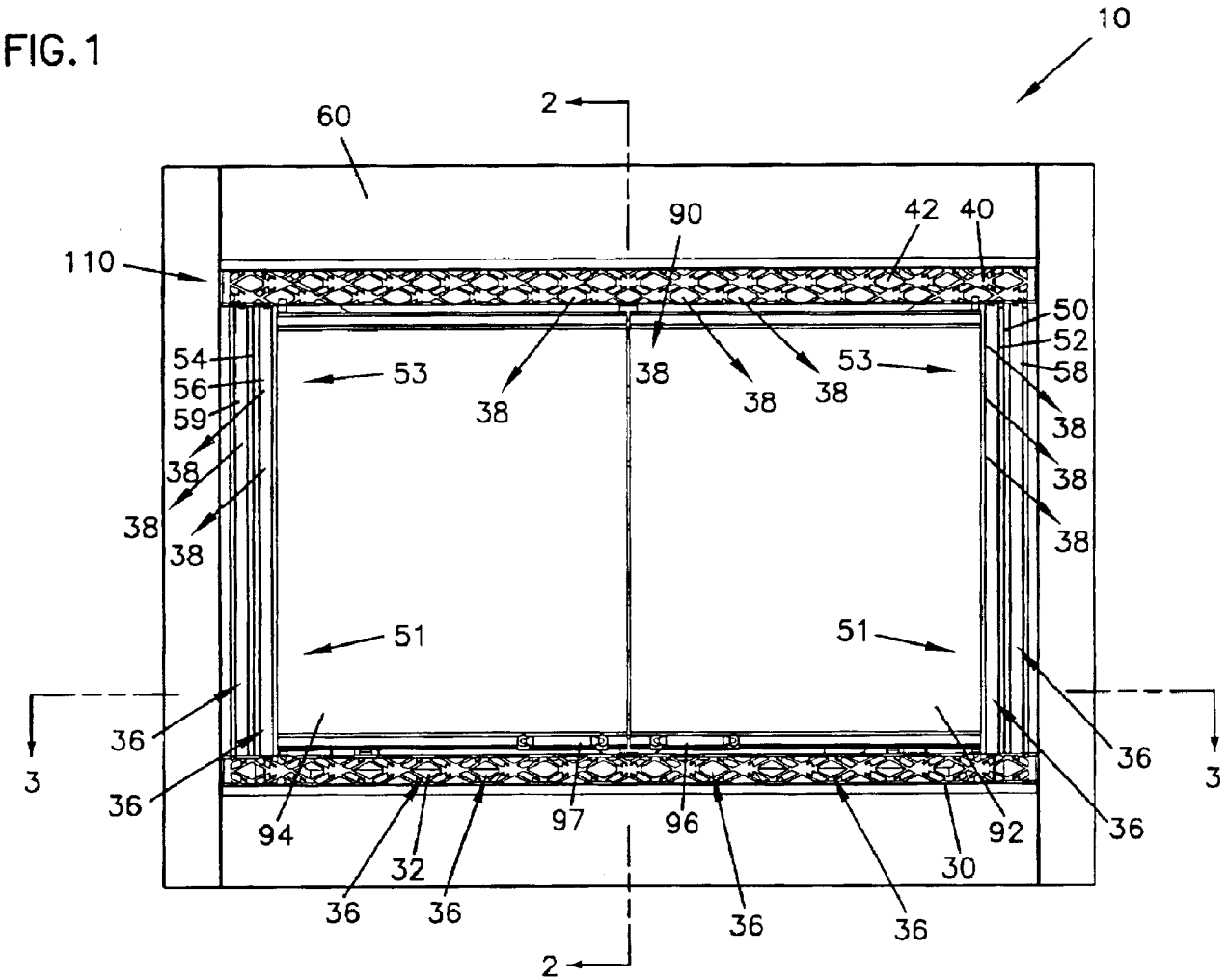
FIG. 1 is a schematic front view of one example embodiment of a fireplace.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

Referring to FIGS. 1–4 an outdoor gas fireplace 10 is illustrated, which includes a combustion chamber enclosure 20 with a front opening 26. The front opening 26 is at least partially covered by a front panel 90. An air intake/gas exhaust system 110 surrounds at least a portion of the front panel 90. The air intake/gas exhaust system 110 includes a bottom intake 30 defining at least one bottom intake opening 32, a top exhaust 40 defining at least one top exhaust opening 42, and a pair of intake/exhaust openings 50, 54 partially covered by two optional pairs of side grille bars 52, 56 and 58, 59. A gas burner assembly 70 is situated on the floor panel 28 of the combustion chamber enclosure 20.

The combustion chamber enclosure 20 of the outdoor gas fireplace 10 is defined by a back panel 22, a pair of side panels 23 and 24, a top panel 25, a floor panel 28 and a front opening 26. Alternatively, the combustion chamber enclosure can be configured with any number of panels or walls. Combustion occurs in the outdoor gas fireplace 10 within the combustion chamber 100 defined by the combustion chamber enclosure 20 and the front panel 90 that at least partially covers the front opening 26 of the combustion chamber enclosure 20 and the air intake/gas exhaust system 110 that at least partially surrounds the front panel 90.

The back panel 22, pair of side panels 23 and 24, top panel 25 and floor panel 28 may be made of a refractory material which maximizes the heat output of the outdoor gas fireplace 10 when it is in operation and minimizes the heat pass through to the surfaces exterior to the combustion chamber enclosure 20. However, it can be appreciated by one skilled in the art that any material that is noncombustible could be used in the preparation of the back panel 22, pair of side panels 23 and 24, top panel 25 and floor panel 28. For example, the back panel 22, pair of side panels 23 and 24, top panel 25 and floor panel 28 can be formed from inorganic ceramic fibers and a binder.

The combustion chamber enclosure 20 can be formed by any known molding technique, such as, for example, compression molding and vacuum forming techniques. Exemplary compression molding compositions and forming techniques are described in pending U.S. Patent Publication No. 2003/0049575 A1, which is incorporated herein by reference. Additional exemplary molding compositions and forming techniques are described in U.S. Pat. Nos. 5,941,237; 5,996,575 and 6,170,481; which are incorporated herein by reference. Alternatively, these panels can be constructed of another material such as sheet metal or stainless steel.

The back panel 22, pair of side panels 23 and 24, top panel 25 and floor panel 28 may be formed as individual panels or formed as a single integrated unit. Except for the air intake/gas exhaust system 110 surrounding at least part of the front of the outdoor gas fireplace 10, intake and exhaustion of air and combustion products should be minimized through the back panel 22, pair of side panels 23 and 24, top panel 25 and floor panel 28 to facilitate the unique airflow design incorporated into the outdoor gas fireplace 10. One feature of the outdoor gas fireplace 10 is that it does not require an exhaust gas vent in either the top panel 25, back panel 22 or either of the pair of side panels 23 and 24.

The front panel 90 can be translucent, typically made of glass, so that the operator can view the burning fire in the outdoor gas fireplace 10. However, it can be appreciated that the front panel 90 can be made from any material which will not be damaged by the burning fire and/or heat generated in the outdoor gas fireplace 10, when the outdoor gas fireplace 10 is in operation.

In one preferred embodiment, the front panel 90 is defined by a right door assembly 92 and a left door assembly 94. The right door assembly 92 and left door assembly 94 can be pivotally attached to pivot points 98 along the vertical sides of the front panel 90 allowing the right door assembly 92 and the left door assembly 94 to pivot in an outward fashion away from the front opening 26 of the outdoor gas fireplace 10. However, it can be appreciated by one skilled in the art that a variety of different door arrangements could be utilized in the present invention, including a plurality of doors pivotally attached to the top or bottom of the front panel 90, or a single door pivotally attached to the front panel 90 at the top, bottom or either side, or a front panel 90 in a fixed position in front of the front opening 26.

The right door assembly 92 may include a handle 96 to facilitate opening and closing the right door assembly 92. The left door assembly 94 may include a handle 97 to facilitate opening and closing the left door assembly 94. The handles 96 and 97 can be made from heat-resistant material to protect the operator when using the handles 96 and 97 while the outdoor gas fireplace 10 is in operation. In one embodiment of the outdoor gas fireplace 10, the handles 96 and 97 include a sliding engagement mechanism to prevent the right door assembly 92 and left door assembly 94 from being inadvertently opened when in a closed position. Additionally, an embodiment of the present invention may include a means to bias the right door assembly 92 and left door assembly 94 in a closed position.

The right door assembly 92 and left door assembly 94 are translucent, typically made of glass, so that the operator can view the burning fire in the outdoor gas fireplace 10. However, it can be appreciated that the right door assembly 92 and left door assembly 94 can be made from any material which will not be damaged by the burning fire and/or heat generated in the outdoor gas fireplace 10, when the outdoor gas fireplace 10 is in operation.

To increase the efficiency of the air flow within the combustion chamber 100 the top panel 25 may be constructed at an angle in relation to the back panel 22 and floor panel 25. Any angle greater than about 90° and less than about 180°, relative to the back panel 22, will improve the efficiency of the airflow within the combustion chamber 100. The efficiency of the air flow within the combustion chamber 100 may be further increased by placing the side panels 23 and 24 at an angle relative to the front panel 90 directing the intake air flow towards the gas burner 70. The side panels 23 and 24 can be placed at any angle less than about 90° and greater than or equal to about 45° relative to the front panel 90. However, it can be appreciated by one skilled in the art that combustion chamber 100 can be designed using more than six sides and a variety of different shapes.

To facilitate the draining out of the combustion chamber enclosure 20 of outside weather condition moisture the floor panel 28 can be placed in an inclined position from rear to front. Exemplary inclined floor panel 28 designs are shown and described in U.S. Pat. No. 6,237,588, Outdoor Convertible Wood Burning Fireplace, which is incorporated herein by reference.

Partially surrounding the combustion chamber 100 is a housing 60. The housing 60 is designed to protect the combustion chamber 100 from the elements. The housing 60 may be made from, for example, stainless steel. Alternatively, the housing can be made from any material, such as a non-corrosive material to protect the housing 60 from the elements. The housing 60 may be sealed to reduce condensation entering the fireplace from outside of the housing 60.

As shown in FIG. 1, the bottom intake 30 of the air intake/gas exhaust system 110 runs along at least a portion of the front opening 26 of the combustion chamber enclosure 20. The bottom intake 30 includes a plurality of bottom intake openings 32 to allow fluid connection from the exterior 64 of the outdoor gas fireplace 10 to the combustion chamber 100. The bottom intake 30 may be constructed with any fireproof or fire resistant material such as ceramic, glass or metal. Alternatively, the bottom intake 30 can be configured with a single opening 32 to allow fluid connection from the exterior 64 of the outdoor gas fireplace 10 to the combustion chamber 100. However, it can be appreciated that any number, configuration, design, shape and size of bottom intake openings 32 are possible.

The top exhaust 40 of the air intake/gas exhaust system 110 runs along at least a portion of the front opening 26 of the combustion chamber enclosure 20. The top exhaust 40 is preferably constructed including a plurality of top exhaust openings 42 to allow fluid connection from the combustion chamber 100 to the exterior 64 of the outdoor gas fireplace 10. The top exhaust 40 may be constructed with any fireproof or fire resistant material such as ceramic, glass or metal. Alternatively, the top exhaust 40 can be configured with a single top exhaust opening 42 to allow fluid connection from the combustion chamber 100 to the exterior 64 of the outdoor gas fireplace 10. However, it can be appreciated that any number, configuration, design, shape and size of top exhaust openings 42 are possible.

Two pairs of side grille bars 52, 56 and 58, 59 run along the length of the front opening 26 on either side of the combustion chamber enclosure 20 from the top exhaust 40 to the bottom intake 30. The two pairs of side grille bars 52, 56 and 58, 59 at least partially cover the intake/exhaust openings 50 and 54 respectively. In one embodiment the intake/exhaust openings 50, 54 run along the opposing sides of the right door assembly 92 and the left door assembly 94 respectively.

Figure 4:
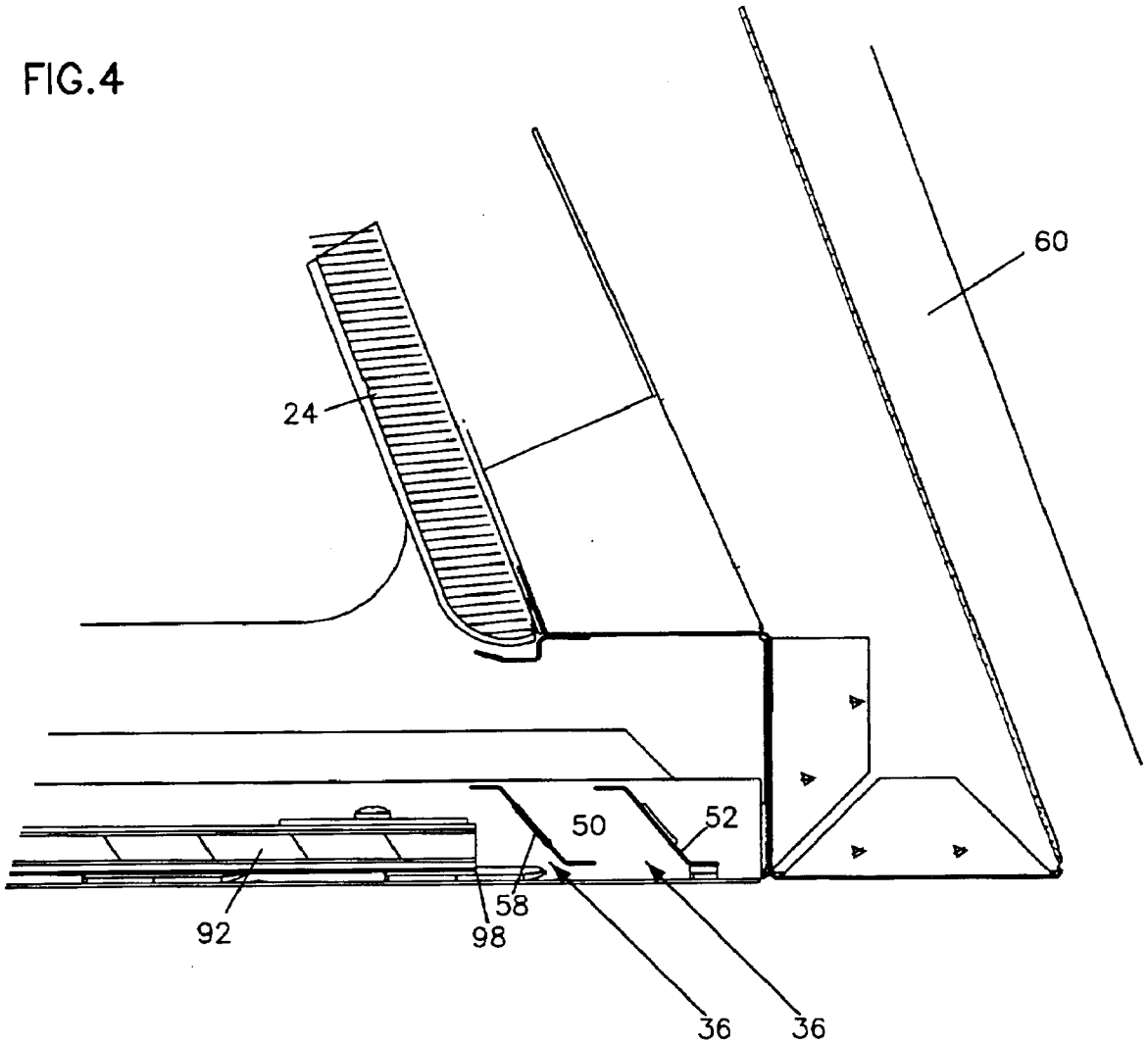
FIG. 4 is an expanded schematic top view of a portion of the fireplace of FIG. 3 illustrating air flow into the fireplace.

As shown in FIG. 4, each pair of side grille bars 52, 56 and 58, 59 are placed at an angular relationship with the pair of intake/exhaust opening 50 and 54 to direct air towards the gas burner assembly 70 and exhaust gases away from the combustion chamber 100.

Figure 2:
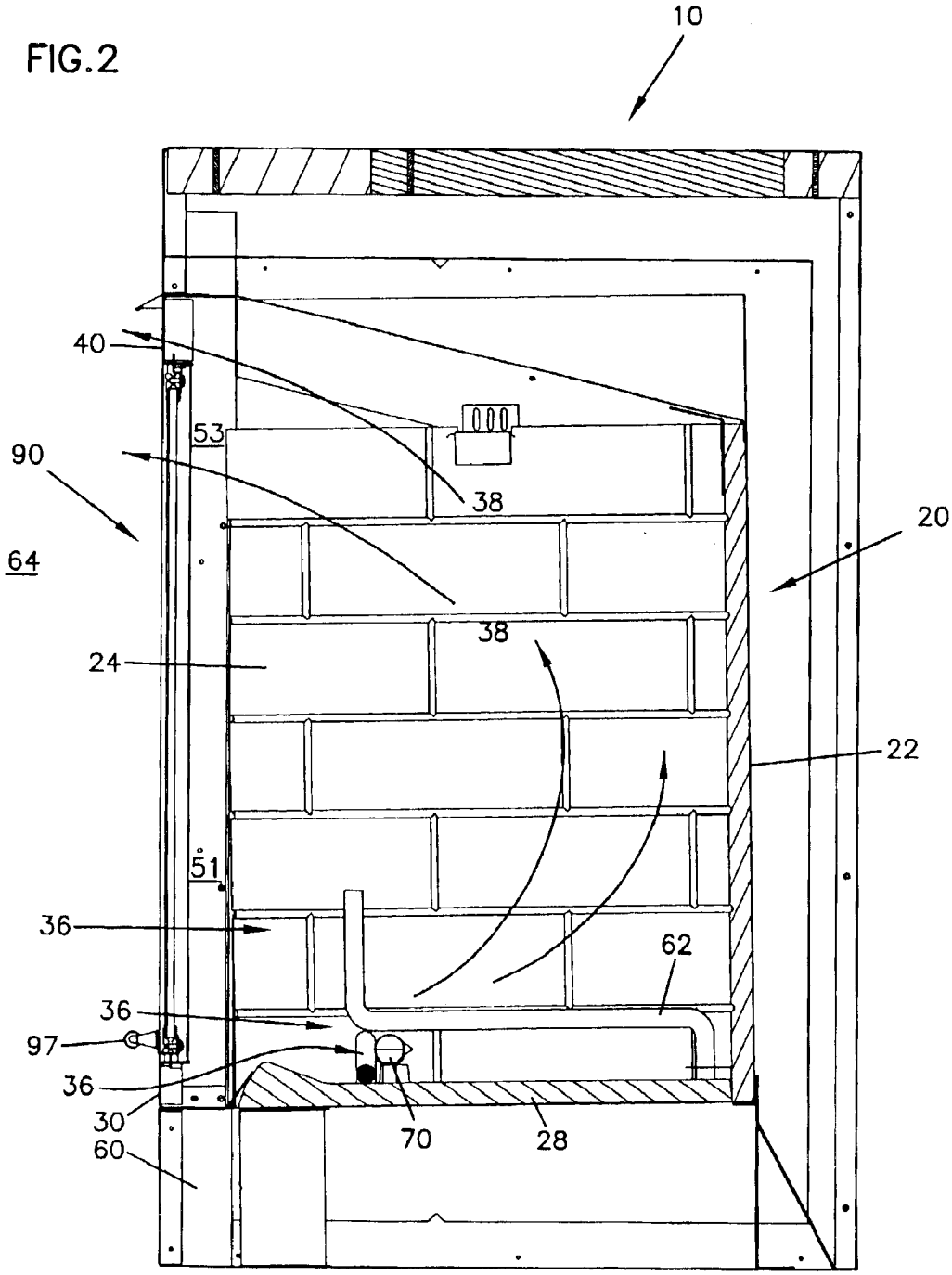
FIG. 2 is a cross-sectional schematic side view of the fireplace of FIG. 1 taken along line 2—2, showing air and gas flow.

In another embodiment of the present invention a single pair of side grille bars 52, 58 run along the length of the front opening 26 on either side of the combustion chamber enclosure 20 from the top exhaust 40 to the bottom intake 30. The single pair of side grille bars 52 and 58 at least partially covers the intake/exhaust openings 50 and 54 respectively. The single pair of side grille bars 52 and 58 is placed at an angular relationship with the pair of intake/exhaust opening 50 and 54 to direct air towards the gas burner assembly 70 and exhaust away from the combustion chamber 100. However, the outdoor gas fireplace 10 could include more than two pairs of side grille bars, or the side grille bars can be removed A side cross-sectional schematic view of the outdoor gas fireplace 10 is shown in FIG. 2. A gas burner assembly 70 is generally disposed on the floor panel 28 within the combustion chamber 100 to provide combustion of gas within the combustion chamber 100. The gas burner assembly 70 is attached to a gas source (not shown) to provide gas for combustion within the combustion chamber 100. A variety of combustible gases may be used, such as LP or natural gas. A grate 62 is situation in the combustion chamber 100 to protect the gas burner assembly 70 from contact with other fire-proof materials, such as artificial logs, placed in the combustion chamber 100.

Figure 3:
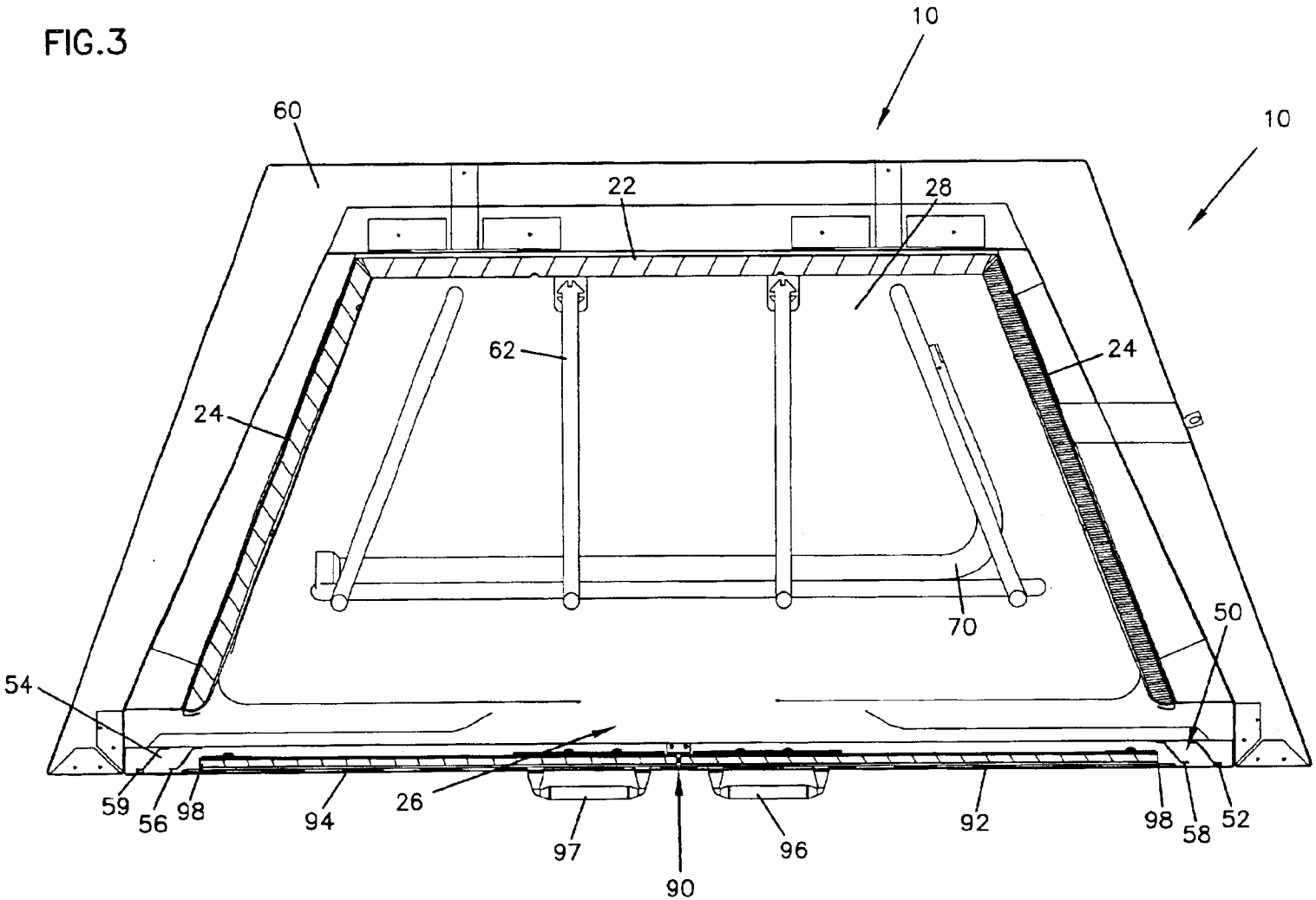
FIG. 3 is a cross-sectional schematic top view of the fireplace of FIG. 1 taken along line 3—3.

In the outdoor gas fireplace 10, combustible gas is provided to the gas burner assembly 70. An ignition source (not shown) is used to ignite the gas. As shown in FIGS. 1–3, fresh air, indicated by arrows 36, is drawn into the combustion chamber through the bottom intake openings 32 and through the lower portion 51 of the intake/exhaust openings 50 and 54. The fresh air mixes with the combustible gas for combustion within the combustion chamber 100. The resulting exhaust gases, indicated by arrows 38, from the combustion travel upward and then exhaust from the combustion chamber 100 through the top exhaust openings 42 and through the upper portion 53 of the intake/exhaust openings 50 and 54. This construction allows for continuous air flow into and exhaust out from the outdoor gas fireplace 10, and for a single opening along the side of the fireplace to allow both intake air to the combustion chamber and exhaust gases to expel from the combustion chamber. Fresh air enters through the air intake/gas exhaust system 110 and the resulting exhaust gases from the combustion are expelled out the air intake/gas exhaust system 110.

The outdoor gas fireplace 10 can be constructed for use as a stand along unit. Alternatively, the outdoor gas fireplace 10 can be used as an insert. In this embodiment the outdoor gas fireplace 10 would be capable of being placed into the exterior wall of a house or other structure.

At least one commercial embodiment of the present invention is the Dakota Outdoor Gas Appliance sold by Hearth & Home Technologies, Inc., 20802 Kensington Boulevard, Lakeville, Minn.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A fireplace viewable from outside of a structure, the fireplace comprising:

a combustion chamber enclosure having a front opening, a bottom panel, and a top panel;

a front panel covering substantially the entire front opening of the combustion chamber enclosure, the front panel comprising a transparent material;

an air intake/gas exhaust system at least partially surrounding the front panel, wherein the combustion chamber enclosure, the front panel and air intake/gas exhaust system define a portion of a combustion chamber; and a gas burner positioned within the combustion chamber to combust a gas/air mixture;

the air intake/gas exhaust system comprising:

a bottom intake opening defined below the front panel and at substantially the same or higher vertical level as the bottom panel to provide air directly to the combustion chamber;

a top exhaust opening defined above the front panel and at substantially the same or lower vertical level as the top panel to exhaust air and combustion products from the combustion chamber; and an intake/exhaust opening defined to the side of the front panel between the front panel and a side edge of the front opening to provide intake of air into the combustion chamber and exhaustion of air and combustion products from the combustion chamber.

2. The fireplace of claim 1, wherein the air intake/gas exhaust system comprises a plurality of bottom intake openings.

3. The fireplace of claim 1, wherein the air intake/gas exhaust system comprises a plurality of top exhaust openings.

4. The fireplace of claim 1, wherein the intake/exhaust opening includes a lower portion and an upper portion, wherein the lower portion allows air into the combustion chamber, and the upper portion allows air and exhaust gases to exhaust the combustion chamber.

5. The fireplace of claim 1, wherein the intake/exhaust opening is at least partially covered by a side grille bar.

6. The fireplace of claim 5, wherein the side grille bar is placed at an angle to direct air to the gas burner and exhaust air and gas away from the combustion chamber.

7. The fireplace of claim 1, wherein the air intake/gas exhaust system comprises a plurality of intake/exhaust openings.

8. The fireplace of claim 7, wherein the plurality of intake/exhaust openings are at least partially covered by a plurality of side grille bars.

9. The fireplace of claim 8, wherein the plurality of side grille bars are angularly placed to direct air to the gas burner and exhaust air and gas away from the combustion chamber.

10. The fireplace of claim 1, wherein the combustion chamber enclosure is further defined by a floor panel, back panel, a pair of side panels and a top panel.

11. The fireplace of claim 10, wherein the top panel is at an angle greater than about 90 degrees and less than about 180 degrees relative to the back panel to facilitate exhaustion of air and gas.

12. The fireplace of claim 10, wherein the side panels are at an angle less than about 90 degrees but greater than about 45 degrees relative to the front opening to facilitate the intake air flow to the gas burner and exhaustion of air and gas from the combustion chamber.

13. The fireplace of claim 1, further comprising a housing at least partially surrounding said combustion chamber enclosure.

14. A fireplace viewable from outside of a structure, the fireplace comprising:

a combustion chamber enclosure having a front opening, a bottom panel, and a top panel;

a front panel covering substantially the front opening of the combustion chamber enclosure, at least a portion of the front panel including a transparent material and being movable between open and closed positions relative to the front opening;

an air intake/gas exhaust system at least partially surrounding the front panel, wherein the combustion chamber enclosure, the front panel and air intake/gas exhaust system define a portion of a combustion chamber; and a gas burner positioned within the combustion chamber to combust a gas/air mixture;

the air intake/gas exhaust system comprising:

a plurality of bottom intake openings defined below the front panel and at substantially the same or higher vertical level as the bottom panel to provide air directly to the combustion chamber;

a plurality of top exhaust openings defined above the front panel and at substantially the same or lower vertical level as the top panel to exhaust air and combustion products from the combustion chamber; and a pair of intake/exhaust openings defined to the sides of the front panel between the front panel and side edges of the front opening to provide intake of air into the combustion chamber and exhaustion of air and combustion products from the combustion chamber to provide intake and exhaustion of air and combustion products.

15. The fireplace of claim 14, wherein the pair of intake/exhaust openings include a lower portion and an upper portion, wherein the lower portion allows air into the combustion chamber, and the upper portion allows air and exhaust gases to exhaust the combustion chamber.

16. The fireplace of claim 14, wherein the pair of intake/exhaust openings are at least partially covered by a pair of side grille bars.

17. The fireplace of claim 14, wherein the pair of side grille bars are placed at an angle to direct air to the gas burner and exhaust air and gas away from the combustion chamber.

18. The fireplace of claim 14, wherein the combustion chamber enclosure is further defined by a floor panel, back panel, a pair of side panels and a top panel.

19. The fireplace of claim 18, wherein the top panel is at an angle greater than about 90 degrees but less than about 180 degrees relative to the back panel to facilitate exhaustion of air and gas.

20. The fireplace of claim 18, wherein the side panels are at an angle less than about 90 degrees but greater than about 45 degrees relative to the front opening to facilitate the intake air flow to the gas burner and exhaustion of air and gas from the combustion chamber.

21. The fireplace of claim 14, further comprising a housing at least partially surrounding said combustion chamber enclosure.

22. A method for providing intake air to and exhausting combustion products from an outdoor fireplace, the method comprising the steps of:

providing a combustion chamber enclosure with a front opening, a top panel, a bottom panel, and a transparent front panel covering a portion of the front opening, the combustion chamber enclosure with the front panel defining a combustion chamber; and providing an air flow into and out of said combustion chamber between a peripheral edge portion of said panel and said front opening, wherein the intake air travels through a lower portion of the front opening at substantially the same or higher vertical level as the bottom panel, and the combustion products exhaust out an upper portion of the front opening at substantially the same or lower vertical level as the top panel;

wherein the intake air enters the front opening at a lower vertical position than where the combustion products exhaust out of the front opening.

23. An air intake/gas exhaust system for an outdoor fireplace with a combustion chamber enclosure having a front opening, a top panel, a bottom panel, and a transparent front panel covering substantially the entire front opening of the combustion chamber enclosure, the combustion chamber enclosure defining a combustion chamber between at least the top, bottom, and front panels, the system comprising:

a bottom intake opening defined below a lowermost portion of the front panel and a bottom edge of the front opening to provide air directly to the combustion chamber;

a top exhaust opening defined above an uppermost portion of the front panel and a top edge of the front opening to exhaust air and combustion products directly from the combustion chamber; and a pair of intake/exhaust openings defined adjacent to opposing peripheral sides of the front panel between the sides of the front panel and side edges of the front opening to provide intake of air into the combustion chamber and exhaustion of air and combustion products from the combustion chamber.

24. The fireplace of claim 23, wherein the pair of intake/exhaust openings include a lower and upper portion, wherein the lower portion allows air into the combustion chamber, and the upper portion allows air and exhaust gases to exhaust the combustion chamber.

25. The fireplace of claim 23, wherein the pair of intake/exhaust openings are at least partially covered by a pair of side grille bars.

26. The fireplace of claim 23, wherein the pair of side grille bars are placed at an angle to direct air to the gas burner and exhaust air and gas away from the combustion chamber.

* * * * *